United States Patent [19]

Garcia

[11] 3,944,793

[45] Mar. 16, 1976

[54] OPERATION COUNTER FOR CABLE ACTUATED MECHANICAL CLUTCHES

[76] Inventor: Uville A. Garcia, 130 NW. 62 Ave., Miami, Fla. 33126

[22] Filed: Sept. 12, 1974

[21] Appl. No.: 505,198

[52] U.S. Cl...... 235/92 PD; 235/92 B; 235/92 TC; 235/92 R; 200/61.85

[51] Int. Cl.[2]..... G07C 3/10

[58] Field of Search..... 235/92 C, 92 PD, 92 B, 235/92 TC, 92 FP, 92 MP; 200/61.85

[56] References Cited

UNITED STATES PATENTS 2,426,287 8/1947 Strout..... 235/92 PD

*Primary Examiner*—Joseph M. Thesz, Jr.

[57] ABSTRACT

A mechanical operation counter for use in association with flexible slide-wire cable utilized for remotely manually controlling the operation of a mechanical device to which the cable is attached. A normally open electrical switching device comprising a microswitch and a slide bar fixed with respect to the cable slide-wire and adapted to actuate the microswitch each time the remote end of the control wire is pushed in or out with respect to its outer sleeve during a manually controlled operation, is connected in series with an energization circuit for an electro-mechanical counter serving to record the number of individual operations being performed upon the controlled mechanism by such manual actuation of the cable slide-wire.

7 Claims, 6 Drawing Figures

OPERATION COUNTER FOR CABLE ACTUATED MECHANICAL CLUTCHES

This invention relates to automatic mechanical operation counters, and is directed particularly to an operation counter for cable-actuated mechanical devices such as power take-off clutches associated with wrecker hoisting winches.

The power take-off mechanism associated with four-wheel drive vehicles is ordinarily controlled by a power take-off clutch lever remotely actuated by the operator through use of a flexible slide-wire cable extending between the take-off clutch at one end of the cable and a manual push-pull knob at the other end of the cable slide-wire and conveniently mounted in the cab of the vehicle for control by the operator. In the case of wrecker vehicles, the power take-off is mechanically connected with a winch or the like lifting and lowering device for the raising and lowering of a disabled vehicle to be transported. The present invention has-for its principal object the provision of an operation counter for such cable-actuated mechanical clutches to enable a wrecker vehicle fleet operator keeping an accurate tally of the number of clutch operations undertaken by the operator or driver of a wrecker during the course of a business day. In this manner, the wrecker fleet operator can determine if unauthorized wrecker service has been rendered by any particular driver of a fleet vehicle during the course of a business day. Such unauthorized and independent wrecker use results in economic loss to the owner not only as to the charges made for such unauthorized service, but also for loss of wrecker time available for use in legitimate and authorized wrecker service.

It is a more particular object of this invention to provide an operation counter of the character described that can readily be installed at any desired position along the length of a clutch actuation cable, well hidden from and substantially inexcessible to the wrecker operator or driver to minimize any possibility of tampering therewith.

Yet another object of the invention is to provide an operation counter of the above nature which can be installed anywhere along the length of flexible slide wire cable for registering on an electro-mechanical counter the number of operations being performed on a controlled device to which the cable is connected.

A more particular object of the invention is to provide an electrical switching device of the character described including a micro-switch and means carried by the cable slide-wire for actuating the micro-switch to energize an electro-mechanical counter for registering thereon each time the cable wire is manually pulled or pushed upon for effecting a mechanical operation upon a controlled mechanism to which the cable is attached.

Other objects, features and advantages of the invention will be apparent from the following description when read with reference to the accompanying drawings. In the drawings, wherein like reference numerals denote corresponding parts throughout the several views.

Figure 1:
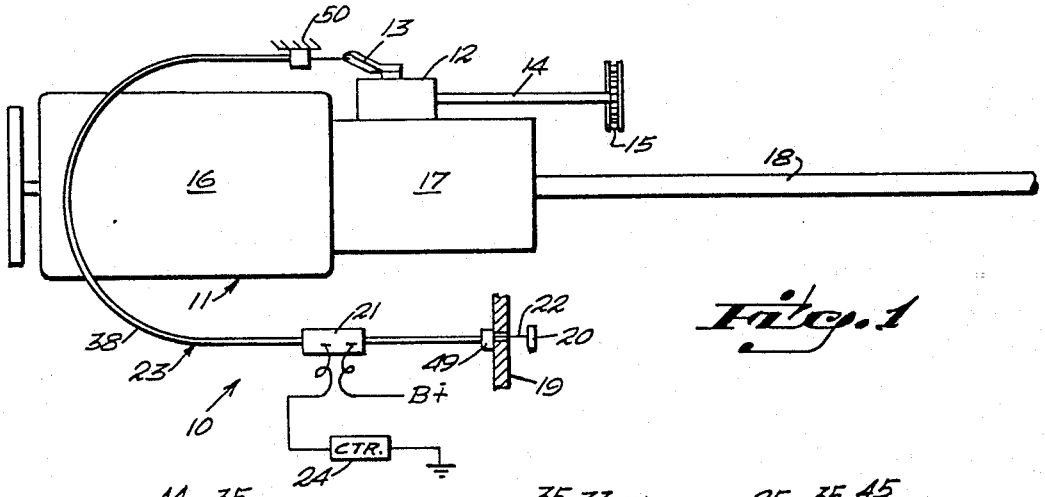
FIG. 1 illustrates, schematically, an operation counter embodying the invention shown in association with the take-off clutch mechanism of a wrecker vehicle for counting lift and lowering operations of the winch mechanism.

Referring in detail to the drawings, reference numeral 10 designates, generally, an operation counter embodying the invention, the same being illustrated for use in association with a wrecker vehicle engine 11 having a power take-off gear box 12 controlled by a power take-off clutch lever 13 for setting into operation a power take-off drive shaft 14 carrying a take-off drive gear 15 powering a winch or the like mechanism (not illustrated) for lifting and lowering a disabled vehicle to be transported. FIG. 1 further illustrates, by way of example and in block form, the vehicle motor 16, main clutch and transmission gear box 17 and drive shaft 18 for powering the rear wheels of a typical wrecker to which the present invention is applied. Reference numeral 19 in FIG. 1 designates a portion of the dash-board or instrument panel of the vehicle in which the actuating knob 20 is installed for take-off clutch operation in the manner hereinbelow more particularly described.

A salient feature of the invention resides in the provision of an electrical switching device 21 connected in series with and operated by the control or slide wire 22 of a flexible slide wire cable 23, the control wire being linked at one end to the power take-off clutch lever 13 of the power take-off 12, and extending at its other end through the dashboard or instrument panel 19 of the wrecker vehicle for manual control of the power take-off clutch upon manual pulling and pushing of the control knob 20 by the wrecker winch operator. As is hereinbelow more particularly described, each time the power take-off clutch actuating control knob is pulled outwardly of the dash-board for engagement of said power take-off clutch to operate the hoist mechanism or winch, an electrical switch comprising the electrical switching device 21 will be close-circuited to complete an energization circuit to electro-mechanical counter 24 through vehicle battery B+, as is hereinbelow more particularly described.

Figure 2:
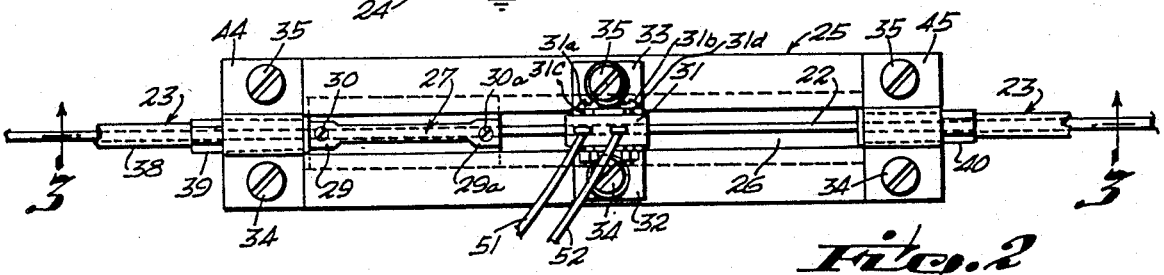
FIG. 2 is a plan view of the cable actuated switch mechanism comprising the invention.
Figure 3:
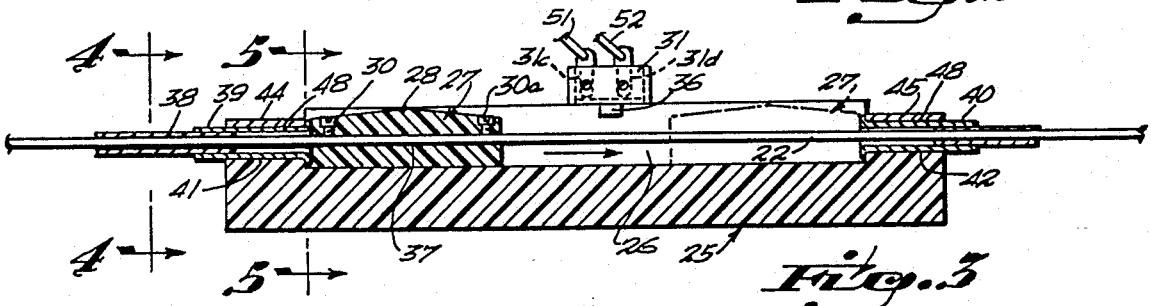
FIG. 3 is a longitudinal cross-sectional view of the cable-actuated switch mechanism, taking along the line 3 — 3 of FIG. 2 in the direction of the arrows.

As illustrated in FIGS. 2 and 3, the electrical switching device 21 comprises an elongated housing member 25, which is approximately square in cross-sectional shape. The housing member 25 will preferably be molded of a touch, non-electrically conductive synthetic plastic material, and is formed centrally along its length with an inverted T-shaped groove 26 opening into the upper surface thereof. Slideably disposed within the T-shape groove 26 is an elongated slide bar 27 of conforming T-shape configuration and having an upstanding switch actuating abutment portion 28. As best illustrated in FIG. 3, the switch actuating abutment portion 28, at its central position therealong, extends upwardly substantially to the upper surface of the elongated housing member 25, and tapers symetrically to each end to present a rounded configuration as seen in elevation. As best illustrated in FIG. 2, the ends of the switch actuating abutment portion 28 are formed with opposed portions of increased width, indicated at 29 and 29*a*, to accommodate vertically-extending set screws 30, 30*a*, respectively, for the purpose hereinafter appearing.

A normally open electrical microswitch 31 is centrally supported along the top surface of the elongated housing member 25 by means of angle brackets 32, 33 held in place as by self-tapping screws 34, 35, respectively. The microswitch 31 is adjustably secured in place between the brackets 32, 33 by means of a pair of transverse machine bolts 31*a*, 31*b* vertically adjustably received within opposed pairs of vertical slots 31*c* and 31*d* in said brackets (see FIG. 3). The microswitch 31 is so adjustably positioned that as the elongated slide bar 27 moves past it in its sliding movement within the inverted T-shape groove 26 from one end of the housing member 25 to the other, as represented, for example, by movement from the full-line position representation thereof to the broken-line position representation thereof in FIG. 3, the upstanding switch actuating abutment portion 28 serves to actuate or depress the microswitch actuating button 36 to momentarily close-circuit said switch. As hereinbelow more particularly described, such microswitch actuation momentarily closes the electrical energization circuit of the operation counter 24 to record a power take-off clutch operation.

Figure 4:
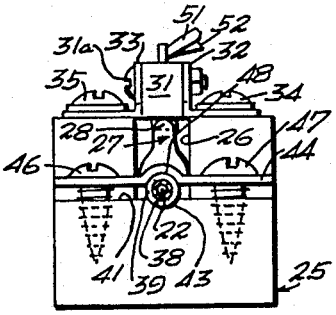
FIG. 4 is a vertical cross-sectional view of the cableactuated switch mechanism, taken along the line 4 — 4 of FIG. 3 in the direction of the arrows.
Figure 5:
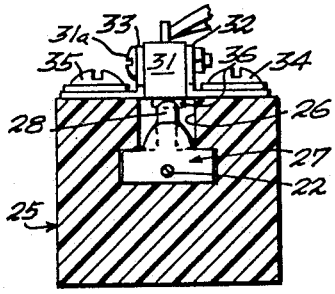
FIG. 5 is a vertical cross-sectional view of the cableactuated switch mechanism, taken along the line 5 — 5 of FIG. 3 in the direction of the arrows.

Cable controlled means is provided for moving the elongated slide bar 27 back and forth within its elongated housing member 25 upon manual operation of the power take-off clutch actuating knob 20 by the operator of the wrecker vehicle hoist mechanism. To this end, the elongated slide bar 27 is formed with a longitudinal opening 37 through which the control wire 22 of the slide wire cable 23 extends (see FIGS. 3 and 5). The elongated slide bar 27 is secured in adjusted position along the control wire 22 by means of the above-described set screws 30, 30*a*. The electrical switching device 21 is installed at any convenient position along the length of the flexible slide wire cable 23, and will preferably be located at a relatively inaccessable position in the engine compartment, for example, to minimize the possibility of tampering therewith. As illustrated in FIGS. 2, 3 and 4, in the installation of the electrical switching device 21, the outer sleeve 38 of the flexible slide wire cable 23 will be cut at an appropriate position to permit removal of the severed-away portion for threading in place of the control wire 22 through the longitudinal opening 37 of the elongated slide bar 27. After the electrical switching device 21 has thus been fitted in place, the severed-away portion of the cable outer sleeve 38 will be replaced, and the severed ends of said outer sleeve will be clamped in place at each end of the elongated housing member 25. To this end, the facing severed ends of the cable outer sleeve 38 will be fitted with metal ferrules 39 and 40 which are clamped against recessed or cut-away surface portions 41, 42, respectively, at each end of the elongated housing member 25. As is best illustrated in FIG. 4, the cut-away surface portions 41, 42 are provided with aligned, shallow, arcuate recesses 43 (only one illustrated in FIG. 4) within which the cable sleeve ferrules 39, 40 seat. Transversely-extending metal clamps 44, 45 are in clamping disposition over the ferrules 39, 40 as by self-tapping screw 46, 47, respectively. As is best illustrated in FIG. 4, the clamps 44, 45 are formed with a shallow arcuate depression 48 conforming to the curvature of the ferrules 39, 40 for enhanced grip on said ferrules.

Figure 6:
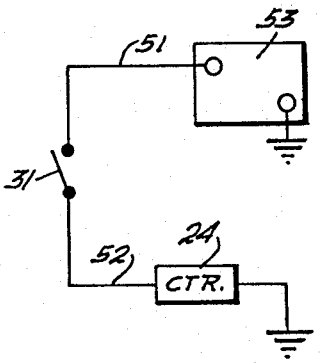
FIG. 6 is an electrical schematic diagram of the energizing circuit for the electro-mechanical recording counter embodying the invention.

In the use of the operation counter, installation along the slide wire cable 23 will be such that when the power take-off clutch lever 13 is in clutch disengaged position, as illustrated in FIG. 1, the control wire actuating knob 20 will be in fully inserted position with respect to the dashboard, and the elongated slide bar 27 will be in its limit position facing the control direction of the power take-off clutch lever (see also FIG. 3). In this connection it is to be noted that the outer ends of the control wire outer sleeve 38 will be anchored, respectively, to the dashboard 19, as indicated at 49, and to support structure fixed relative to the wrecker truck chassis as indicated at 50 in FIG. 1. When the operator of the winch or hoist mechanism wishes to set it into operation for lifting or lowering a disabled vehicle, for example, he will pull the actuating knob 20 outwardly a distance of about 3 to 4 inches, causing sufficient turning of the power take-off clutch lever 13 in the foreward direction of the wrecker to engage the power take-off transmission with consequent powering of the winch to operate in one direction of the other, depending upon whether the engine transmission 17 is set in foreward or reverse gear, to raise or lower a vehicle. With reference to FIGS. 2 and 3, it will be seen that as the control wire 22 is thus actuated to engage the power take-off mechanism, the elongated slide bar 27 will be carried from the position illustrated by the full line representation thereof in FIG. 3 to the position indicated by the broken line representation thereof, during which travel, as is hereinabove described, said slide bar will have actuated the microswitch 31 to temporarily close its normally open electrical switch. As illustrated schematically in FIG. 6, the microswitch 31 is series-connected with an electromechanical counter 24 through conductors 51, 52 interconnecting the wrecker vehicle battery 53 and said counter. The remaining terminals of the vehicle battery 53 and the counter 24 are returned to vehicle chassis ground to complete the energization circuit for said electromechanical counter. Thus, each time the microswitch 31 is actuated upon pulling out or pushing in of the control wire actuating knob 20 as described above, the counter 24 will receive an electrical energizing impulse operative to advance its counting mechanism by one unit. Since the electro-mechanical counter 24 is interconnected with the microswitch 31 by a simple electrical conductor 52 and can be returned to chassis ground at nearly any location within the wrecker cab or within the engine compartment of the wrecker vehicle, for example, it can conveniently be placed at any position, whether readily observably or hidden from direct view, desired by the owner of the vehicle.

Since a towing job will normally involve four control cable operations, that is, winch lift start by pulling outwardly upon the actuating knob 20 for raising a vehicle, raised vehicle stop by next pushing the actuating knob in again, then winch lowering by again pulling outwardly upon the actuating knob, and then winch lowering stop upon finally pushing the control knob in again, a single towing job from pick-up to release of a towed vehicle will register four counts on the electromechanical counter 24. If, however, it is desired to record only one unit on the counter for each towing job, that is, for completion of all of the four operational steps of a completed towing job, the counter 24 could be of such design as to record one unit for each group of four impulses received by actuation of the electrical switching device 21.

While I have illustrated and described herein only one form in which my invention can conveniently be embodied in practice, it is to be understood that this form is presented by way of example only and not in a limiting sense. The invention, in brief, comprises all the embodiments and modifications coming within the scope and spirit of the following claims.

What I claim as new and desire to secure by Letters Patent is:

1. In a mechanical operation counter for use in association with a flexible slide-wire cable utilized for remotely manually controlling the operation of a mechanical device to which one end of the cable is attached, the slide-wire cable being comprised of an outer sleeve member and a control wire co-axially slideable within the sleeve member, the improvement comprising, a normally open electrical switch, depressable means for momentarily close-circuiting said electrical switch, a slide member secured to the control wire intermediate the ends thereof and moveable in unison with said control wire within a gap defined by a longitudinally extending cut-away portion of the outer sleeve member of the slide-wire cable, means for fixedly supporting said electrical switch with respect to opposing end portions of the outer sleeve member defining said gap, said slide member comprising abutment means for actuating said switch close-circuiting depressable means as said slide member moves in unison with the control wire in one direction or the other between the ends of said gap, an electrically actuated counter and an electrical energizing circuit for said counter, said electrical switch being connected in series in said energizing circuit.

2. A mechanical operation counter as defined in claim 1 wherein said energizing circuit comprises the wrecker vehicle engine battery.

3. A mechanical operation counter as defined in claim 1 and further comprising an elongated housing member, means for securing marginal opposing end portions of the outer sleeve member at said gap with respect to end portions of said elongated housing member, a longitudinal groove in said housing member through which the control wire extends and within which said slide member is slideably disposed, said means for fixedly supporting said electrical switch comprising bracket means secured to said elongated housing member.

4. A mechanical operation counter as defined in claim 3 wherein said electrical switch comprises a microswitch having a depressable actuating button directed into said groove.

5. A mechanical operation counter as defined in claim 4 wherein said groove is T-shape in cross-sectional configuration and said slide member is of conforming cross-sectional configuration.

6. A mechanical operation counter as defined in claim 4 wherein said electrical switch supporting means comprises a pair of angular brackets, a plurality of opposed, elongated slots in said brackets, said microswitch being disposed between said brackets, and machine screws extending through opposed pairs of said slots and operative to adjustable clamp said microswitch between said brackets.

7. A mechanical operation counter as defined in claim 3 including a wrecker vehicle engine having a lever-actuated power take-off clutch and an instrument panel, one end of said slide wire cable control wire being connected to said clutch lever and the other end of said slide wire cable control wire being disposed at said instrument panel and having handle means for manually pushing and pulling upon said control wire with respect to said outer sleeve member for simultaneously actuating said clutch control lever and said slide member.

* * * * *